US007721354B2

(12) United States Patent
Yu et al.

(10) Patent No.: US 7,721,354 B2
(45) Date of Patent: May 25, 2010

(54) GLOVE WITH INTEGRALLY FORMED ARM TROUGH FOR CAPTURING LIQUIDS AND A METHOD THEREFOR

(75) Inventors: Loo Liong Yu, Selangor (MY); David Mark Lucas, Selangor (MY); Ong Chin Kok, Pahang Darul Makmur (MY); Karunagaran A/L Arumugam, Kedah (MY); Dave Narasimhan, Flemington, NJ (US)

(73) Assignee: Ansell Healthcare Products LLC, Red Bank, NJ (US)

( * ) Notice: Subject to any disclaimer, the term of this patent is extended or adjusted under 35 U.S.C. 154(b) by 798 days.

(21) Appl. No.: 11/533,982

(22) Filed: Sep. 21, 2006

(65) Prior Publication Data

US 2008/0092261 A1 Apr. 24, 2008

(51) Int. Cl.
*A41D 19/00* (2006.01)

(52) U.S. Cl. ..... 2/167; 264/301

(58) Field of Classification Search ..... 2/167; 264/301

See application file for complete search history.

(56) References Cited

U.S. PATENT DOCUMENTS

| | | | | |
|---|---|---|---|---|
| 2,117,417 | A | 5/1938 | Hall | |
| 2,821,718 | A | 2/1958 | Hall et al. | |
| 3,601,816 | A * | 8/1971 | Pordes et al. | 2/167 |
| 4,095,293 | A | 6/1978 | Heavner et al. | |
| 4,399,567 | A * | 8/1983 | Weon Joong | 2/161.6 |
| 4,845,781 | A | 7/1989 | Strickland et al. | |
| 4,984,299 | A | 1/1991 | halldorsdottir | |
| 5,682,612 | A | 11/1997 | Schwarz | |
| 5,953,756 | A | 9/1999 | Vrissimdjis | |
| 6,092,237 | A | 7/2000 | Baldwin | |
| 6,249,917 | B1 | 6/2001 | Vrissimdjis et al. | |
| 6,968,572 | B1 | 11/2005 | Johnson et al. | |
| 7,480,945 | B2 * | 1/2009 | Knuth et al. | 2/162 |
| 2005/0229287 | A1 | 10/2005 | Mattesky | |

OTHER PUBLICATIONS

"PCT International Search Report, Apr. 4, 2008", International Application No. PCT/US07/79168.

"PCT Written Opinion, Apr. 4, 2008", International Application No. PCT/US07/79168.

* cited by examiner

*Primary Examiner*—Katherine Moran
(74) *Attorney, Agent, or Firm*—Diehl Servilla LLC; Karen M. Whitney; Kenneth M. Zeidner

(57) ABSTRACT

A glove with an integrally formed arm trough has a hand portion, arm portion and a cuff portion. The arm portion is provided with a first ridge, a second ridge with a larger diameter compared to the arm portion, and a third ridge. During use, the third ridge is pushed towards the first ridge by the user to extend the second ridge away from the arm and towards the hand portion forming a liquid capturing trough while the cuff portion protects from the arm from liquid exposure. The length between the third ridge and the second ridge is larger than the length between the first and second ridge so that the trough created has a positive cone angle and a depth to sufficient to provide liquid volume capacity. The ridges are shaped as sharp edges or C-sections to provide easy forming of the liquid capturing arm trough.

20 Claims, 6 Drawing Sheets

GLOVE WITH INTEGRALLY FORMED ARM TROUGH FOR CAPTURING LIQUIDS AND A METHOD THEREFOR

FIELD OF THE INVENTION

The invention relates to an integrally formed glove suited for medical use, chemical handling and general washing applications wherein dripping of any fluid from the finger region to the cuff region below the wrist portion of the glove that results in contamination of ungloved regions or undesirable glove feel is prevented. This one-piece integrally formed glove has portions of the glove that extend or project from the glove arm region providing capture of dripping liquid from the finger region.

BACKGROUND OF THE INVENTION

Gloves are commonly used to protect hands in industrial or household applications. When the wearer of the glove handles liquids, typically these liquids run down the fingers and eventually make their way into the cuff region. At this stage, depending on the glove cuff geometry, the liquid may run down the skin or into the cuff of a surgical or protective gown, which is generally positioned in between the glove interior surface and the skin of the user. In the case of a surgical glove, the body fluids of a patient may carry bacterial or viral contaminants and the doctor may receive these infectious fluids. In the worst case, the medical professional or other patients may be infected. In the case of a mechanic or a chemical technician using a standard glove, oil or other chemical liquids may run down the surface of the glove contaminating or soiling the uniform or skin of chemical technician or mechanic.

A number of patents relate to providing gloves with tighter cuff retention through cuff geometry or providing a cuff region of a glove that is flipped by the user to capture any liquid that runs down the surface of the glove. The tightened cuff region approach does not inherently prevent the entry of the liquid into the interior of the glove, since this entry of the liquid into the interior of the glove is essentially controlled by the contact angle, the surface tension and viscosity properties of the liquid being dripped. The liquid can enter the glove interior by capillary action. In the case of the flipped cuff region approach, the flipped region of the glove acts as a reservoir with a single layer of latex. Since the liquid is generally heavy, especially when the flipped glove region has a large volume, any movement of the hand spills the liquid at the edges of the flipped region, which again run down the external surface of the glove towards unprotected skin. In the worst case scenario, the flipped cuff of the glove that has a single layer of latex may flip back by the weight of accumulated liquid unexpectedly, since the side walls of flipped the single layer latex reservoir are generally very thin. In this case, all the accumulated liquid flows down the cuff into the skin or the interior of a surgical gown. In both these cases, the entry of the spilled liquid into the interior of the glove depends on the contact angle, surface tension and viscosity of the liquid being spilled. Therefore the intended desired functionality of the tight cuff or flipped cuff is defeated by these inherent drawbacks.

U.S. Pat. No. 1,407,658 to Kelly discloses a wristlet. This is a thin rubber device worn by wrist of the operator. The cylindrical portion of the wristlet surrounds the wrist while the attached flared portion collects any drips produced by washing a painted surface or windows with a sponge. The wristlet is not provided with a glove and there is no protection provided to the fingers of the user. Liquid captured by the flared portion may leak between the cylindrical seal portion and the wrist at the center of the wristlet.

U.S. Pat. Nos. 2,106,346 and 2,117,417 to Hall et al. disclose a static resisting garment. The rubber glove is folded over to form a trough at the cuff to prevent static build-up. This garment has nothing to do with capturing drips in a surgical or washing application.

U.S. Pat. No. 2,821,718 to Hall et al. discloses rubber glove with reinforced turn back cuff. This rubber glove has the flared cuff portion annularly grooved and is provided with annular row of longitudinal corrugations. These corrugations are intended to provide some strength to the flipped region while the annular grooves assist flipping of the glove. The glove is originally designed to provide static shield and is also useful for housewives in handling liquids or in various industrial applications. The cuff portion when turned up provides shielding from static electricity. The turned back cuff acts as a trough preventing liquids from running down the arms of the wearer. The edge of the glove has a rolled bead. The same annular grooves that provide easy flipping of the glove may allow the thin latex layer to turn back to suddenly spill all the liquid that has accumulated. There is no glove extension or liquid protection below the turned back cuff.

U.S. Pat. No. 4,845,780 to Reimers et al. discloses glove having improved cuff-securing features. The cuff region of a medical glove is provided with a tab with an acrylic adhesive. The adhesive attaches the cuff portion securely to the wearer. The tab prevents glove roll down and entry of foreign materials into the interior of the glove. The tab is attached to the interior of the glove and is attached to the exterior of the cuff to create a snug fit. There is no indication that this snug fit at the wrist prevents the entry of liquids. As seen in FIG. 3 of the '780 patent, a cone is created at the tab region enabling entry of liquids into the interior of the glove. Any liquid present runs down the glove into the skin region or into a surgical gown since no capture means are provided.

U.S. Pat. No. 4,884,300 to Vistins discloses glove having improved cuff-securing features. An acrylic adhesive is provided on a portion of the cuff of a medical glove. The adhesive secures the portion of the cuff to other portions of the cuff for tightening the cuff when the glove is on the wearer's hand. The adhesively attached cuff portion can be easily removed. As shown in FIG. 3 of the '300 patent, the cuff region of the glove folds over itself being secured by the adhesive. There is no indication that this snug fit at the wrist prevents the entry of liquids. Any liquid present runs down the glove into the skin region or into a surgical gown since no capture means are provided.

U.S. Pat. No. 5,682,613 to Schwartz discloses applicator glove and method of use. The applicator glove has absorbent pads adjacent to thumb and fingers that hold herbicides for treating selected plants. The cuff of the glove is inverted forming a trough to catch any drips. The quantity of liquid handled by the glove is small and the inverted cuff portion is subject to opening out and spilling any collected liquid, especially if the liquid quantity accumulated is large.

U.S. Pat. Nos. 5,953,756 and 6,249,917 to Vrissimdjis disclose glove of rubber or the like. The glove of rubber is provided with a tubular sleeve portion and a cuff portion, which extends conically outwardly in extension of the sleeve portion. The cuff portion can be folded back such that the free end of the conically outwardly extending cuff portion has a radial distance from the outer circumference of the sleeve portion. The portion adjacent to the fold back portion is thickened and at the fold back region thinned. This change in thickness is created by providing sharp curvatures in the latex dipping mold changing the nominal accumulation of coagulated latex at the transition regions. The liquid is collected in the fold back region, but the weight of the liquid collected may be adequate to flip the cuff of the glove back, particularly at the reduced thickness regions, thereby spilling all the collected liquid on the user's skin or surgical gown. There is no liquid protection provided below the folded cuff portion.

U.S. Pat. No. 6,092,237 to Baldwin discloses drip catching glove construction. This device is for use by mechanics. A drip catching glove construction includes a glove member fabricated from a waterproof material and having an elongated wrist portion. The wrist portion is provided with a collar unit, which includes a peripheral sponge member and a peripheral skirt member, which surrounds the sponge member and defines a liquid containment reservoir. The throat of the reservoir is partially obstructed by the sponge member. The collar unit is separate from the glove and has to be attached. The sponge also needs to be attached. This collar unit of the drip catching glove is not manufacturable by dipping a former in a latex emulsion due to the presence of multiple layers at the same physical location. The '237 disclosure does not teach how this drip catching glove is manufactured. The drip catching glove can only capture as much liquid as absorbed by the sponge and excess liquid may destabilize the single layer of waterproof material. In a second embodiment, a wristlet is worn on bare hand that has an absorbent pad member contained within a waterproof resilient construction provided with a porous covering to admit and trap fluids. There is no glove in this second embodiment.

U.S. Pat. No. 6,968,572 to Johnson et al. discloses fluid barrier arm cuff. The present invention is directed to a fluid barrier apparatus for an arm. The apparatus includes a seal portion defining an opening for the arm. The seal restricts passage of fluid between clothing or bare skin and the apparatus. The apparatus includes a basin, which is connected to the seal. The basin collects any fluids running down the arm not passing through the seal or fluids, which may occasionally fall on the basin. The apparatus further includes a lip portion adjacent to the basin, which contains the fluids within the basin. Finally, the apparatus includes a drain for draining the accumulated fluids out of the basin. The drain can be a spout, drain holes, a cutout area in the lip, conduits, tubing, pipes, and the like. The fluid barrier is applied to arm over the skin or clothing to capture dripping liquid. There is no glove provided to protect the skin from contacting the fluid. Any fluid that drips down from the basin reaches the clothing or skin immediately.

U.S. Patent application 20050229287 to Mattesky discloses gloves with easily deployed cuff catcher. The glove body is made from an elastomeric material and is sized and shaped to receive a wearer's hand. The body has a cuff portion including a first end, which is connected to the body, and a second end, which is positioned opposite the first end. The cuff portion includes an annular ridge, which is included as an inserted elastomeric article slipped on a former and cures integrally with the glove body. This annular ridge assists folding over of the cuff of the glove at the annular ridge. When the cuff of the glove is folded, it forms an open pocket, whereby materials falling from the body during the use of the glove can be caught by the pocket. However, the pocket thus formed is of a single layer of latex which may not contain liquids and is subject to folding back spilling out all the liquid or other materials collected on the skin or surgical gown of the user.

Accordingly, there is a need in the art for a sturdy liquid catching trough positioned at or near the arm of the wearer protecting the skin and surgical gown, thereby preventing unwanted spills and contamination of patients and doctors in the case of a surgical glove. The portion of the arm below the trough needs to be protected from contacting any of the spilled liquid. Moreover, the liquid catching trough must have sufficient rigidity to contain the trapped liquid, not spill the contents on the skin or gown of the wearer. Preferably, the glove with a trough and arm protection should be easy to manufacture as a unitary body having adjustable features to provide a trapping geometry most suited for the user of the glove.

SUMMARY OF THE INVENTION

One aspect of the present invention provides an integrally formed glove having a unitary body that has sufficient length to protect the hand and arm of the user. The arm portion of the glove is below the wrist portion of the glove and is generally tapered with the diameter of the glove at the arm portion gradually increases to accommodate the arm of the user comfortably. This is called out here as the arm portion rather than a cuff portion since the arm portion is expected to be longer in length and comprises features that enable the formation of a liquid capturing trough. The portion of the glove below the trough is hereby termed as the cuff portion of the glove. The glove has nearly uniform latex wall thickness with predictable stretching properties. The glove can be manufactured by dipping a coagulant treated shaped glove former in a latex emulsion.

The glove of the present invention has three geometrically defined ridges in the arm portion of the glove. These ridges are portions where the glove folds easily resulting in the formation of a liquid capturing trough. These ridges may be in the form of easy to bend molded sharp edges or ridges with a C shaped cross section. The glove bends easily along the direction of the open edges of the C shaped ridge while it is relatively more difficult to bend the glove in the opposite direction. In the C shaped ridge arrangement, the first and third ridges of the glove are grooves in the form of a C shaped section that faces away from the arm surface. The second ridge of the glove is a projection that has the C shaped section facing the arm. The first and third ridges have a diameter that is nominally matching to the general taper of the arm portion, but the glove diameter at the second ridge has a larger diameter, typically in the range of 1.2 to 1.5 times the nominal diameter of the arm at this location, based on the general taper of the arm of the glove. The distance between the first and second ridge is L1 and that between second and third ridge is L2. The ratio of L2 to L1 is generally in the range of 1.05 to 1.5 for reasons detailed below.

When the user initially wears the glove, it covers the hands and the arm of the user. The glove is generally snug and tight at the first and third ridge locations and is looser at the second ridge of the arm portion of the glove. This is due to the larger diameter of the latex glove at the second ridge as compared to the general taper of the arm portion of the glove. The user progressively displaces the third ridge towards the first ridge thereby extending the second ridge outward from the arm to create an integrally formed trough from the glove. The portion of the latex glove between the first ridge and second ridge and the portion of the glove between the second ridge and third ridge extends away from the arm and essentially forms a trough, since the distance L2 is greater than distance L1. The bottom of the trough is in essence at the first ridge while the second ridge forms the lip of the trough. The trough faces the hand portion of the glove and is adapted to catch any liquid that drains down the arm. The trough sidewalls are strong and do not bend back under the weight of the liquid captured due to the presence of two supporting layers of latex. The inner layer of the trough sidewalls is the latex layer between the first and second ridge, while the outer layer is the latex layer between the second and third ridge. The overall diameter of the lip of the trough is determined by the diameter of the second ridge and the angle of the trough is determined by the length between the first and second ridge L1, length between the second and third ridge L2 and the distance L3 between the third ridge and the first ridge which is variable depending upon the displacement by the user. The liquid fill capacity of the glove is determined by the diameter of the second ridge and the angle of the trough thus formed by the user displacing the third ridge toward the first ridge. A smaller displacement of the third ridge toward the first ridge results in a large trough angle, which has a reduced trough volume capability.

Since the trough is supported by two layers of latex, the interior layer being the latex layer between the first and second ridges and the outer layer being the latex layer between the second and third latex layers, the trough is mechanically strong and can hold the entire filled volume of the liquid without flipping over. Moreover, since the diameter of the glove at the second ridge is substantially larger than the diameter of the arm, any spilled liquid spills away from the arm and does not enter the cuff or the gown of a surgeon. The arm portion below the trough, which is the latex glove that lies below the third ridge, provides protection to the arm of the user in this integrally formed latex glove.

The glove is gathered by the user by bringing the third ridge towards the first ridge while at the same time extending the second ridge away from the arm crating a trough that is pointed towards the hand portion of the glove. This configuration naturally occurs since the distance L1 between the first and second ridge is smaller than the distance L2 between the second and third ridges. The angle of the cone of the trough progressively decreases and the depth of the trough correspondingly increases thereby increasing the volumetric capacity of the trough to retain liquids. This double layer construction of the trough as formed by the extension of the second ridge results in a rigid structure, which does not readily flop back even when sufficient liquid is accumulated in the nearly full trough.

The method of manufacturing glove with integrally formed arm trough involves first producing a specially shaped former which has the general shape of a human hand with arm portion. The arm portion of the former is tapered with progressively increasing diameter as a function of distance from the hand portion resembling the shape of a human arm. The arm portion of the former has a first ridge, in the form of a sharp line or a protrusion with a C shaped cross section. A second ridge is a sharp edge or a groove with a C shaped cross section is located at a distance L1 from the first ridge. A third ridge is a sharp edge or a protrusion similar to the first ridge with a C shaped cross section, located at a distance L2 from the second ridge. The diameter of the groove at the second ridge is larger than that is based on the general taper of the arm. As a result, a cone shape is formed on the former between the first ridge and second ridge and an inverse cone is formed between the second ridge and third ridge.

This specially formed former is dipped in a coagulant solution such as calcium nitrate and dipped in a latex emulsion to coagulate a latex layer on the former. The thickness of the latex layer formed is generally uniform in cross section. In the case of C shaped ridges, the thickness of the latex layer at the first and third protrusions and second groove is slightly larger than the general thickness of the latex layer, due to the C shaped curvature of the protrusions and groove. The latex layer on the former is washed to remove processing chemicals and heated to a vulcanization temperature in the range of 160-180° C. in an oven to cure the latex layer. The latex layer is now stripped from the former and becomes inverted. In the case of C shaped ridges, the first and third ridges formed by replicating the protrusions of the former now become grooves in the stripped glove and tends to curve the latex away from the interior of the glove. The second ridge, which was a C shaped groove in the former, now becomes a protrusion in the inverted glove, and the glove at the second ridge tends to curve towards the interior of the glove. Thus the larger diameter second ridge naturally likes to extend from the arm assisted by the curvature provided by the first and third C shaped ridges. The behavior is exactly similar when sharp edges are provided at the first second and third ridges. The user can easily move the third ridge towards the first ridge integrally forming an arm trough to capture any liquid that runs down the arm of the glove from the hand portion.

DETAILED DESCRIPTION OF THE INVENTION

Figure 1A:
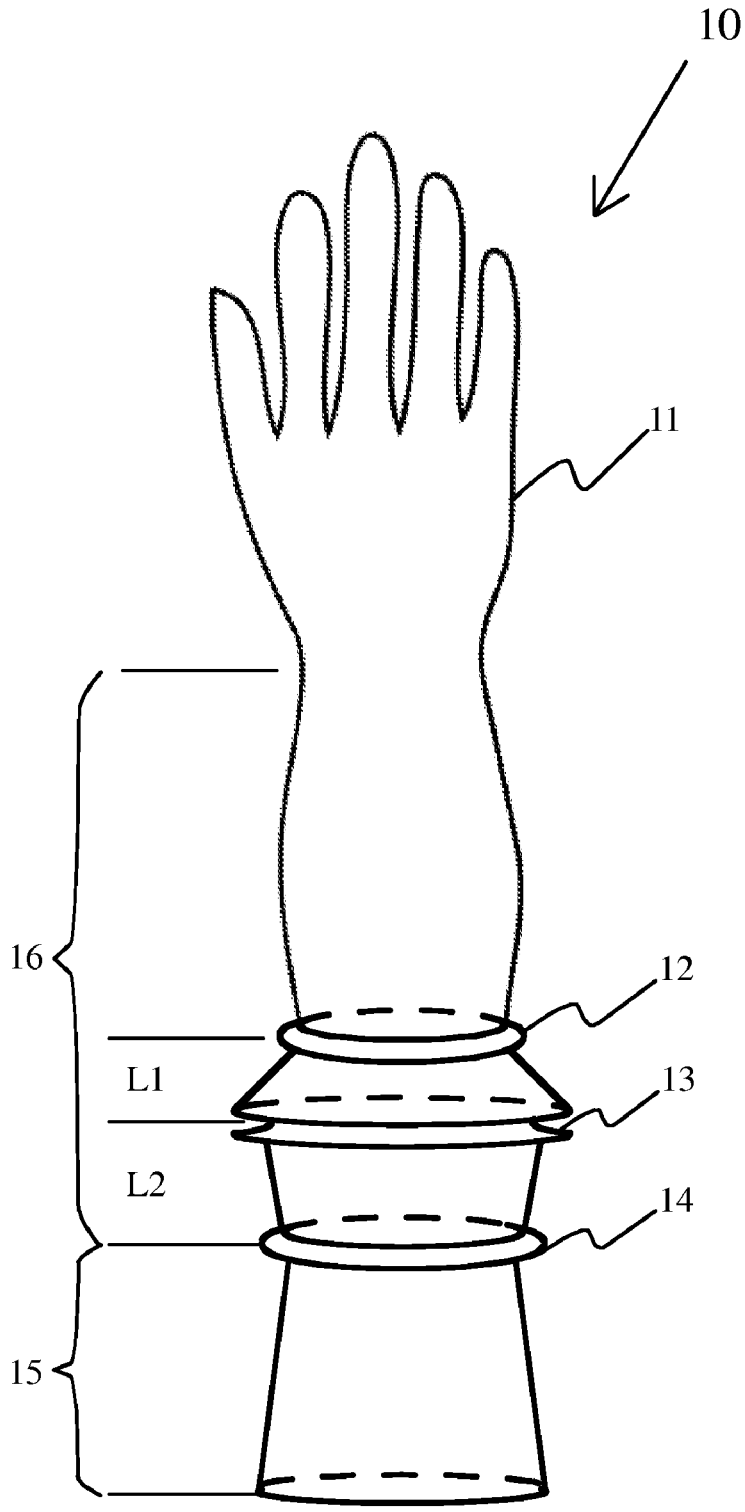
FIG. 1*a* shows a schematic diagram of a former for producing an integrally formed glove with a trough according to the first embodiment of the invention.

The glove with an integrally formed arm trough for capturing liquids includes a latex elastomeric glove having hand covering portions and arm covering portions. The arm covering portion has three discrete ridges encircling the arm. The first and third ridges may be a sharp ridge or a c shaped ridge that are concave in nature and fold easily away from the arm. The central second ridge may be a sharp ridge or a c shaped ridge that is concave in nature and folds inwards towards the arm. The diameter of the latex glove at the second ridge location is substantially larger, typically 1.25 to 1.5 times, than the nominal diameter of the arm at this location and the glove essentially 'hangs out' at the second ridge. The user upon wearing the glove of the present invention pushes the third ridge towards the first ridge pushing out the second ridge outward from the arm. At this stage, the second ridge automatically moves forward towards the hand portion of the glove since the distance between the second ridge and the third ridge (L2) is larger than the distance between the second ridge and the first ridge (L1) nominally in a ratio range of 1.05 to 1.5. The first ridge forms the base of a capturing trough that is cone shaped and the second ridge forms the lip of the trough. The latex layer between the second ridge and the third ridge forms a second layer of latex that acts as a wall for the cone shaped trough.

The angle of the cone and its depth is controlled by the distance between the third ridge and the first ridge, the distance designated as L3. When distance L3 is large, the cone angle is large and the depth of the trough is correspondingly small resulting in small capture volume of liquids. However, when distance L3 is small, the cone angle is small and the depth of the trough is large and the trough holds a larger volume of the captured liquid. The diameter of the second ridge is fixed and the trough in the form of a cone extends downwards from this second ridge. Due to this larger diameter, any spill of liquid does not run down the cuff portion of the glove, but spills away from the user's arm. The portion of the arm below the arm trough is also covered by the glove providing protection from contact with the liquid.

The first embodiment of the invention has all the latex surfaces in the arm region are planar. The second ridge forms a lip with the sharp edge second ridge or a C shaped second ridge and liquid does not spill easily. The two layers of latex that are laterally displaced provide mechanical support to the liquid that is captured and the arm trough does not invert even when hand is vigorously moved.

The second embodiment of the invention is similar to the first except the regions that form the arm trough are provided with a folded bellow like latex surface. This folded architecture of the latex layer between the first and second ridges as well as the latex layer between second and third ridges provides a structure that provides additional mechanical support. While a convex shaped second ridge is desirable, it need not be created from a groove in the former since the bellow structure easily folds in a manner similar to a convex ridge.

The glove of the present invention is manufactured by dipping a specially shaped former coated with a coagulant solution such as calcium nitrate in an aqueous latex emulsion. The aqueous latex emulsion may comprise natural rubber, synthetic polyisoprene, styrene-butadiene, carboxylated or non-carboxylated acrylonitrile-butadiene, polychloroprene, polyacrylic, butyl rubber, or polyurethane (polyester based or polyether based) or combinations thereof. The former has a hand portion and an arm portion matching a human arm and hand. The diameter of the arm portion progressively increases as a function of distance from the hand portion. The middle portion of the arm portion has three ridges that facilitate the formation of the trough by the user. The user pushes the third ridge towards the first ridge thereby extending the second ridge away from the arm and towards the hand portion of the glove forming an arm trough. The cone angle of the trough and its depth from the second ridge determines the volumetric liquid holding capacity of the trough and is controlled by the distance between the first and third ridge.

FIG. 1*a* illustrates the shape of a former 10 used to produce the glove with integrally formed arm trough. The hand portion of the glove is shown at 11. The first ridge is located in the arm portion 16 at 12 and is generally a C shaped projection. When a glove is dipped the latex layer that is inverted has a groove at this location. The groove facilitates bending of the latex layer away from the arm. At a distance L1 from the first ridge 12, a second ridge is provided in the arm portion 16. This ridge is a groove in the former as shown at 13 and forms a convex projection in the inverted latex glove, which facilitates the bending of the latex towards the arm. At a distance of L2 from the second ridge 13 a third ridge is provided in the arm portion 16. This third ridge 14 in the former is a projection similar to the first ridge 12 and produces a groove in the latex glove arm. The region below the third ridge 14 is the cuff portion 15 that protects the arm of the user.

Figure 1B:
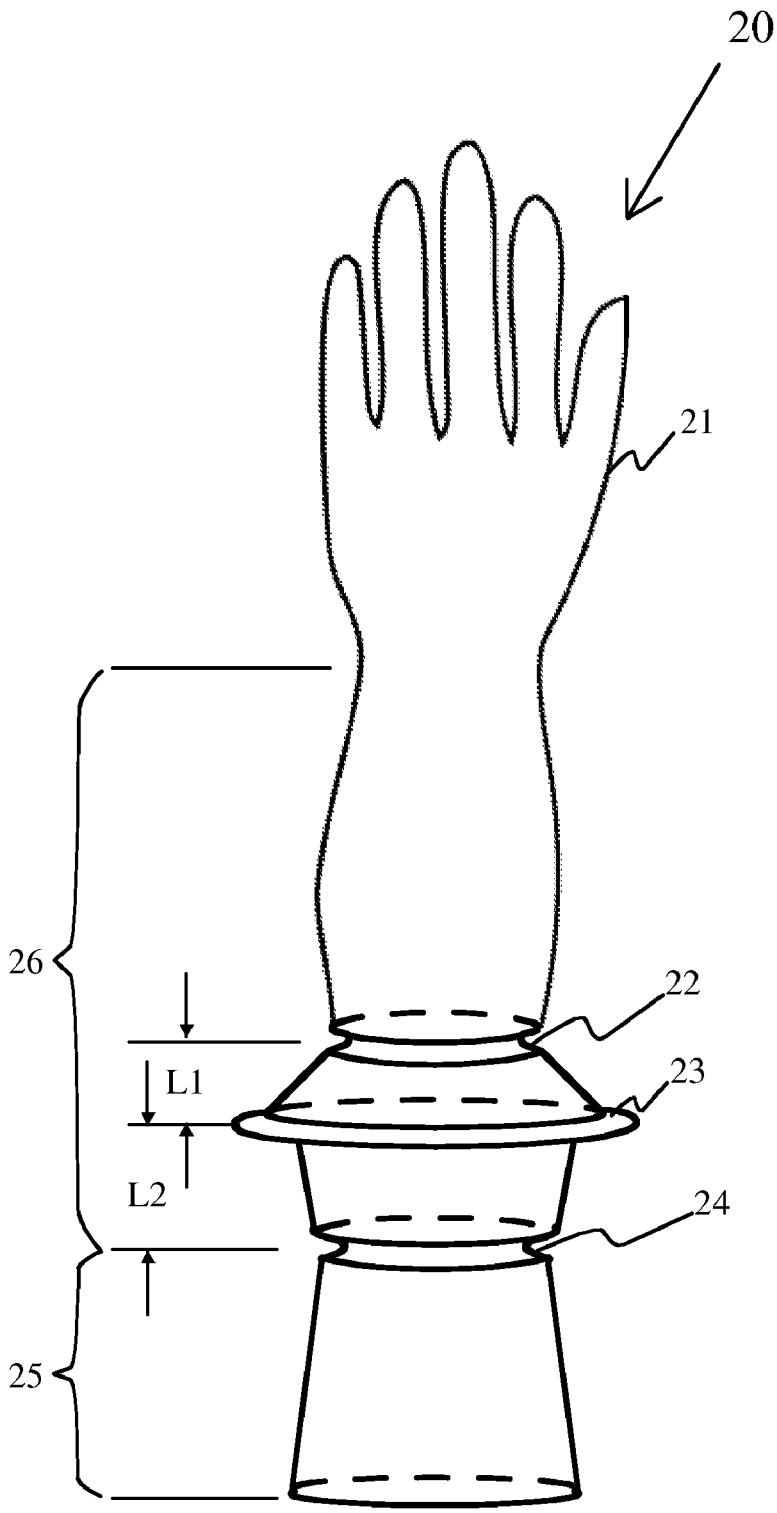
FIG. 1*b* shows a schematic diagram of the glove produced using the former of FIG. 1*a;*

FIG. 1*b* illustrates a latex glove 20 produced using the former of FIG. 1*a*. The hand portion of the glove is shown at 21. The first ridge 22 now appears as a groove in the arm portion 26 of the glove. The second ridge is a projection at 23 in the arm portion 26 of the glove and the third ridge 24 is a groove in the arm portion 26 of the glove similar to the first ridge. The second ridge has a larger diameter than a nominal diameter at the arm portion based on the general taper of the arm and connects to the first ridge and third ridge by conical sections. The cuff portion of the glove is shown at 25. The distance L2 is longer than distance L1.

Figure 1C:
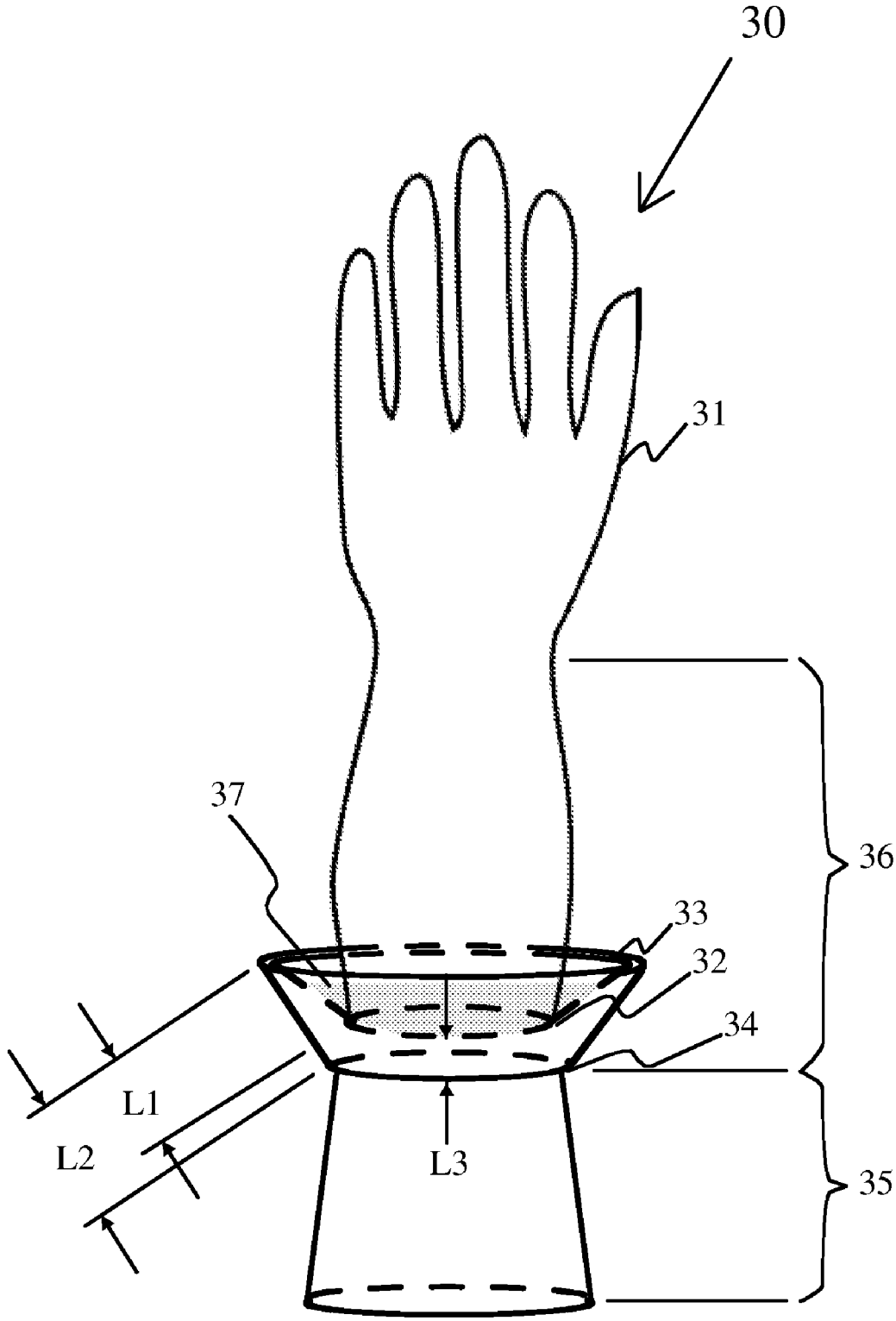
FIG. 1*c* shows a schematic diagram of the glove of FIG. 1*b* with an arm trough with captured liquid.

FIG. 1*c* illustrates the latex glove 30 of FIG. 1*b* worn by a user. The user displaces the third ridge 34 towards the first ridge 32 extending the second ridge 33 away from the arm and towards the hand portion 31 creating a trough that captures liquid shown at 37. The length L2 between the second and third ridge is larger than distance L1 between first and second ridges creating a double wall latex trough. The arm portion of the glove is shown in the folded configuration at 36. The cuff region which protects the arm portion from exposure to liquid is shown at 35.

Figure 2A:
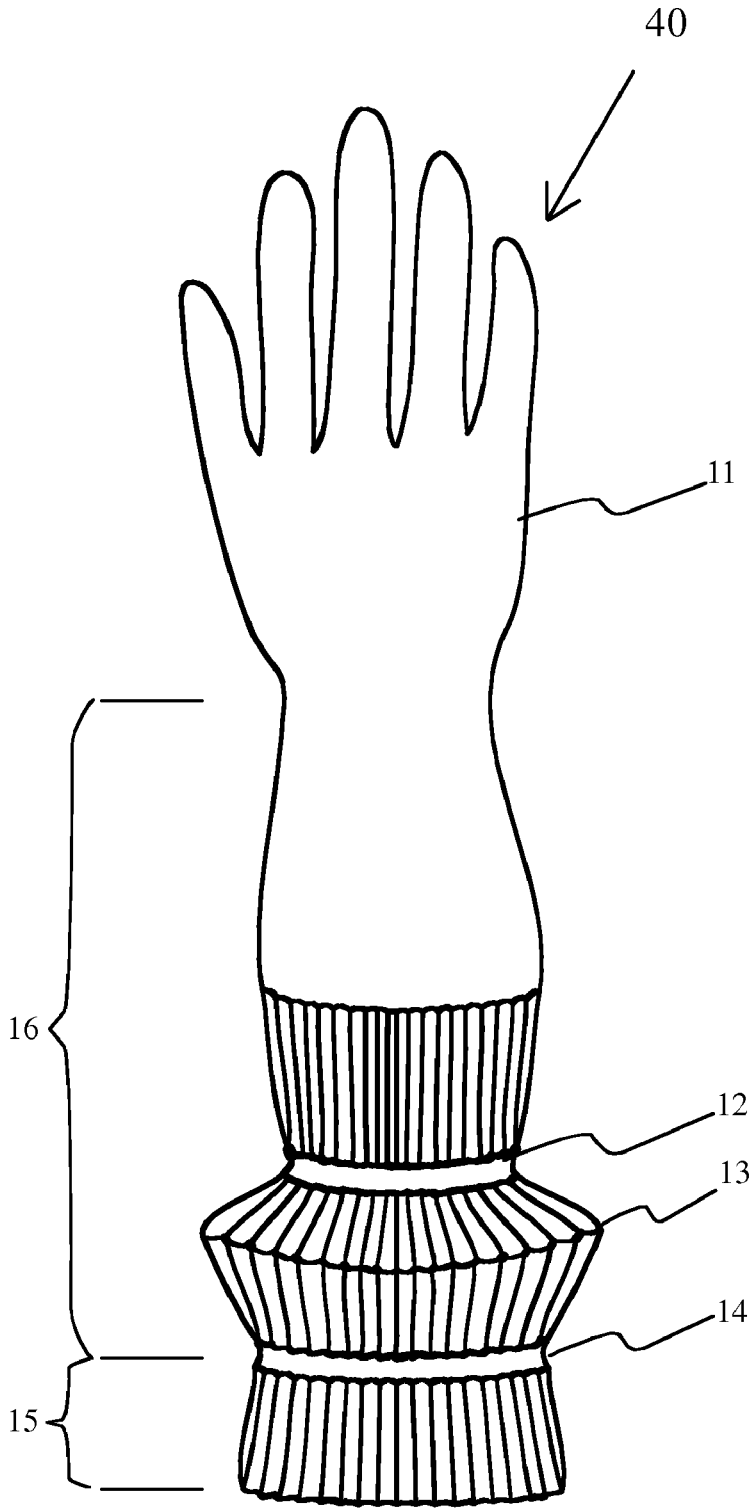
FIG. 2*a* shows a schematic diagram of a former for producing an integrally formed glove with a ribbed arm trough according to a second embodiment of the invention.

FIG. 2*a* illustrates a former 40 of a second embodiment of the invention. The hand portion is shown at 11. The first ridge in the arm portion 16 is shown at 12 as groove in the former. The second ridge in the arm portion 16 is shown as a sharp corner at 13. The second ridge has a larger diameter with conical connections to first ridge and third ridge as shown. The third ridge in the arm portion 16 is a groove in the former shown at 14. The portion between the first ridge and second ridge is ribbed with corrugations. Similarly, the portion between the second ridge and third ridge is also ribbed as shown. The cuff portion is also ribbed as shown at 15. When this glove is dipped in latex, these ribs or corrugations produce corresponding ribs in the latex layer formed providing additional mechanical rigidity when the arm trough is formed.

Figure 2B:
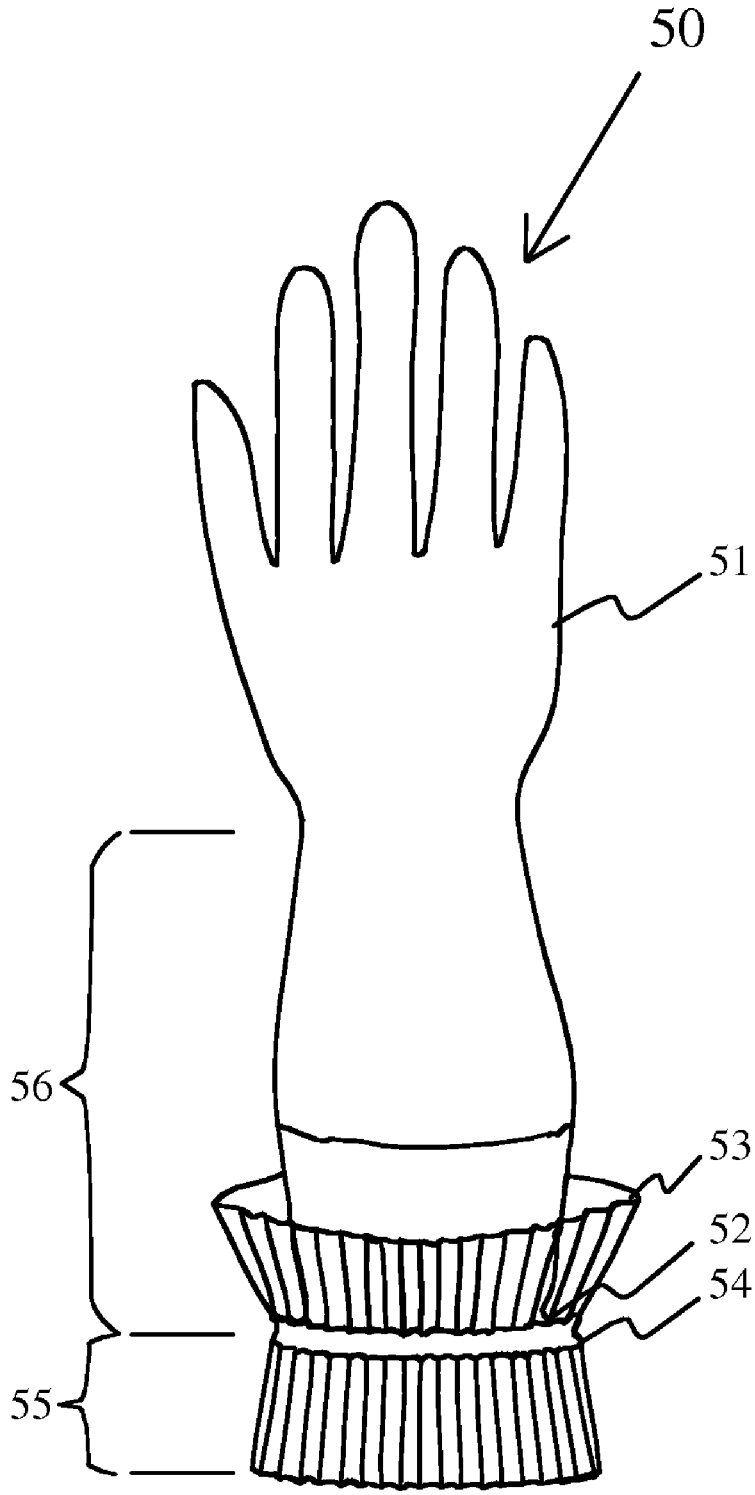
FIG. 2*b* shows a schematic diagram of the glove produced using the former of FIG. 2*a* showing a ribbed arm trough.

FIG. 2*b* illustrates the use of the glove 50 produced using the former of FIG. 2*a*. Note that the glove is not inverted showing grooves at the first ridge 52, third ridge 54 and a sharp edge at second ridge 53. The trough has a sharp upper edge at 53 and has a bottom at the first ridge 52. The latex ribbed or corrugated structure between the first ridge and second ridge forms the inner latex layer. The corrugated latex layer between the second ridge and third ridge forms the outer latex layer for the trough that captures the liquid. The arm portion of the glove is shown at 56. The cuff portion of the glove is shown at 55.

Figure 3:
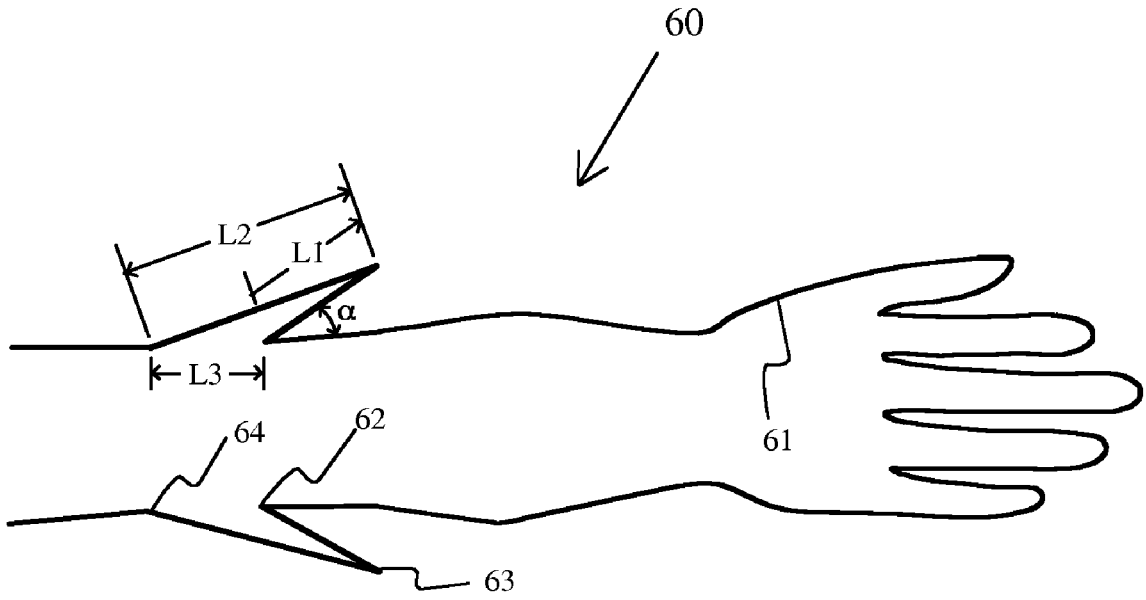
FIG. 3 illustrates the geometrical factors involved in the construction of the arm trough on the latex glove.

FIG. 3 illustrates at 60 the geometrical relationship between the distances L1, L2 and L3 of a glove that has formed an arm trough. The hand portion of the glove is shown at 61. The interior half angle of the cone of the trough is designated as α. 62 is the first ridge and the second ridge is located at 63. The third ridge is shown at 64. The user pushes the third ridge 64 towards the first ridge 62 projecting the second ridge 63 from the arm to form the liquid capturing trough. There is a mathematical relationship between L1, L2, L3 and α, as shown below.

$$\mathrm{Cos}\alpha = \frac{L_2^2 - L_1^2 - L_3^2}{2L_1L_3}$$

Therefore for α, to be a positive value, the length L2 should be larger than length L1. As L3 decreases, the angle, α, decreases.

The maximum liquid capture volume in the trough is given by the formula shown below:

$$\mathrm{TroughVolume}=\pi L_1^3 \mathrm{Sin}^2\alpha \mathrm{Cos}\,\alpha$$

since $$\mathrm{TroughDiameter}=L_1 \mathrm{Sin}\,\alpha$$

$$\mathrm{TroughHeight}=L_1 \mathrm{Cos}\,\alpha$$

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. An elastomeric article, comprising:

an integral latex glove comprising a hand portion, an arm portion and a cuff portion;

the arm portion comprising a first ridge, a second ridge, and a third ridge;

the second ridge having a larger diameter as compared to a diameter of the arm portion;

a first distance between the second ridge and the third ridge being greater than a second distance between the first ridge and the second ridge;

a trough comprising two layers being formed during use of the glove when the third ridge is displaced towards the first ridge thereby resulting in a projection of the second ridge away from the arm portion and towards the hand portion;

wherein the trough is mechanically rigid and substantially resists flipping, and wherein the cuff portion remains after the trough is formed.

2. The elastomeric article of claim 1, wherein the second ridge has a diameter that is in the range of from approximately 1.2 to approximately 1.5 times the diameter of the arm portion.

3. The elastomeric glove of claim 1, wherein the distance between second ridge and third ridge is in the range of from approximately 1.05 to approximately 1.5 times the distance between the first ridge and the second ridge.

4. The elastomeric glove of claim 1, wherein the first ridge is a C shaped groove.

5. The elastomeric glove of claim 1, wherein the third ridge is a C shaped groove.

6. The elastomeric glove of claim 1, wherein the second ridge is a C shaped projection.

7. The elastomeric glove of claim 1, wherein the second ridge is a sharp edge.

8. The elastomeric glove of claim 1, wherein an area between the first ridge and the second ridge is corrugated.

9. The elastomeric glove of claim 1, wherein an area between the second ridge and the third ridge is corrugated.

10. The elastomeric glove of claim 1, wherein an area in the cuff portion is corrugated.

11. The elastomeric glove of claim 1, wherein the latex glove comprises a material selected from the group consisting of natural rubber, synthetic polyisoprene, styrene-butadiene, carboxylated or non-carboxylated acrylonitrile-butadiene, polychloroprene, polyacrylic, butyl rubber, polyester-based polyurethane, or polyether-based polyurethane, or combinations thereof.

12. A process for making an elastomeric glove with an integrally formed arm trough, comprising:

a) creating a glove shaped former comprising a hand portion and an arm portion; the former having a first ridge, a second ridge and a third ridge; the second ridge having a larger diameter than a diameter of the arm portion; a distance between the second ridge and the third ridge being greater than a distance between the first ridge and the second ridge;

b) dipping the former in a coagulant solution to form a coagulant-coated former;

c) withdrawing the coagulant-coated former;

d) dipping the coagulant-coated former in a tank containing an aqueous polymeric latex emulsion;

e) gelling a coating of the polymeric latex on a surface of the coagulant coated former to form a latex coating;

f) withdrawing the former coated the latex coating; and g) heating the former and the latex coating to a temperature to vulcanize the latex coating to form a cured glove.

13. The process of claim 12, further comprising washing the cured glove.

14. The process of claim 12, wherein the first ridge and the third ridge are grooves in the former.

15. The process of claim 12, wherein the first ridge and the third ridge are projections in the former.

16. The process of claim 12, wherein the second ridge is a projection in the former.

17. The process of claim 12, wherein the second ridge is a sharp corner in the former.

18. The process of claim 12, wherein the second ridge has a diameter that is in the range of from approximately 1.2 to approximately 1.5 times the diameter of the arm portion.

19. The process of claim 12, wherein a distance between the second ridge and the third ridge is in the range of from approximately 1.05 to approximately 1.5 times a distance between the first ridge and the second ridge.

20. The process of claim 12, wherein the aqueous polymeric latex emulsion comprises a material selected from the group consisting of natural rubber, synthetic polyisoprene, styrene-butadiene, carboxylated or non-carboxylated acrylonitrile-butadiene, polychloroprene, polyacrylic, butyl rubber, polyester-based polyurethane, or polyether-based polyurethane, or combinations thereof.

* * * * *